US011053769B2

(12) United States Patent
Craycraft

(10) Patent No.: US 11,053,769 B2
(45) Date of Patent: Jul. 6, 2021

(54) BACK PRESSURE VALVE PLUG

(71) Applicant: Northern Oil Solutions, Soldotna, AK (US)

(72) Inventor: James D. Craycraft, Soldotna, AK (US)

(73) Assignee: Northern Oil Solutions, Soldotna, AK (US)

( * ) Notice: Subject to any disclaimer, the term of this patent is extended or adjusted under 35 U.S.C. 154(b) by 131 days.

(21) Appl. No.: 16/677,467

(22) Filed: Nov. 7, 2019

(65) Prior Publication Data

US 2020/0248523 A1 Aug. 6, 2020

Related U.S. Application Data

(60) Provisional application No. 62/918,494, filed on Feb. 2, 2019.

(51) Int. Cl.

| | |
|---|---|
| ***E21B 33/12*** | (2006.01) |
| ***E21B 34/02*** | (2006.01) |
| ***E21B 33/04*** | (2006.01) |
| ***E21B 47/117*** | (2012.01) |

(52) U.S. Cl.

CPC ..... *E21B 33/12* (2013.01); *E21B 33/04* (2013.01); *E21B 34/02* (2013.01); *E21B 47/117* (2020.05)

(58) Field of Classification Search

CPC ..... E21B 33/12; E21B 47/117; E21B 34/02; E21B 33/04; E21B 47/10

See application file for complete search history.

(56) References Cited

U.S. PATENT DOCUMENTS

| | | | | |
|---|---|---|---|---|
| 2,250,244 A * | 7/1941 | Yancey | ..... | E21B 33/068 29/213.1 |
| 2,294,499 A * | 9/1942 | Henkell | ..... | E21B 34/02 138/44 |
| 2,830,666 A * | 4/1958 | Rhodes | ..... | E21B 34/02 166/97.1 |
| 2,939,534 A * | 6/1960 | Allen | ..... | E21B 33/047 166/97.1 |
| 4,287,912 A * | 9/1981 | Hewett | ..... | F16K 15/044 137/516.27 |
| 4,825,945 A * | 5/1989 | Smith | ..... | E21B 34/02 166/87.1 |
| 6,409,146 B1 | 6/2002 | Van Essen | | |

(Continued)

OTHER PUBLICATIONS

MCM, "MCM Oil Tools", www.mcmoiltools.com, 4 pgs.; retrieved Sep. 16, 2019.

*Primary Examiner* — Steven A MacDonald
(74) *Attorney, Agent, or Firm* — Thorpe, North & Western, LLP

(57) ABSTRACT

A plug tool is presented to selectively plug a back pressure valve (BPV) in a tubing hanger associated with a wellhead of a well. The plug tool and the BPV can seal bottom hole pressure from the well during removal of the Christmas tree, and can retain control of the well while the Christmas tree is removed. The plug tool and the BPV allow a blowout preventer (BOP) to nipple-up and be tested without removing the BPV and without replacing the BPV with a two-way check valve. The plug tool has lower threads to engage internal threads of the BPV, and upper threads to be engaged by a retrieval tool. The plug tool has a seal to seal with the BPV above the internal threads and below a notch.

19 Claims, 5 Drawing Sheets

(56) References Cited

U.S. PATENT DOCUMENTS

| | | | | |
|---|---|---|---|---|
| 6,938,696 | B2 | 9/2005 | Dallas | |
| 7,578,351 | B2 | 8/2009 | Dallas | |
| 8,499,842 | B2 * | 8/2013 | Nguyen | E21B 33/12 166/386 |
| 8,539,976 | B1 * | 9/2013 | Rodgers, Jr. | E21B 34/02 137/512 |
| 8,939,216 | B2 | 1/2015 | Nguyen | |
| 9,404,321 | B2 * | 8/2016 | Williams | B66C 1/66 |
| 2014/0116720 | A1 * | 5/2014 | He | E21B 21/10 166/373 |
| 2015/0068768 | A1 * | 3/2015 | Williams | E21B 19/00 166/380 |
| 2016/0186527 | A1 * | 6/2016 | Cocker, III | E21B 33/03 166/379 |
| 2019/0040709 | A1 * | 2/2019 | Garner | E21B 33/1208 |

* cited by examiner

BACK PRESSURE VALVE PLUG

PRIORITY CLAIM

Priority is claimed to U.S. Provisional Patent Application Ser. No. 62/918,494, filed Feb. 2, 2019, which is hereby incorporated herein by reference.

BACKGROUND

A back-pressure valve (BPV) is a type of check valve, typically installed in the tubing hanger, to isolate the production tubing. The back-pressure valve is designed to hold pressure from below to isolate well pressure, yet enable fluids to be pumped from above as required for well-control purposes, such as to kill the well. Thus, a BPV reduces downtime and operating cost by allowing for repairs without killing the well. The BPV is commonly used during the nipple down and up (removal and installation) of the drilling blow out preventer (BOP) stack, nipple up or down (installation and removal) of a Christmas tree, testing of the Christmas tree or BOP (with a different 2-way check valve), and during the replacement of the master valve. A common type of BPV is the Cameron Type H BPV. It is sometimes necessary to remove the Christmas tree or repair the lower master valve of the well. Thus the BPV can be reinstalled in the hanger without killing the well.

When the BOP is set, it must be tested against something. A different two-way check valve is used and replaces the BPV to check that the BOP seals in both directions. Sometimes there is pressure in the well from below, and the two-way check valve cannot be removed without a special tool called a lubricator. A lubricator is not typically kept on site, and often requires an inordinate amount of time to obtain. In addition, a lubricator is a complicated tool that requires an experienced operator to utilize.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
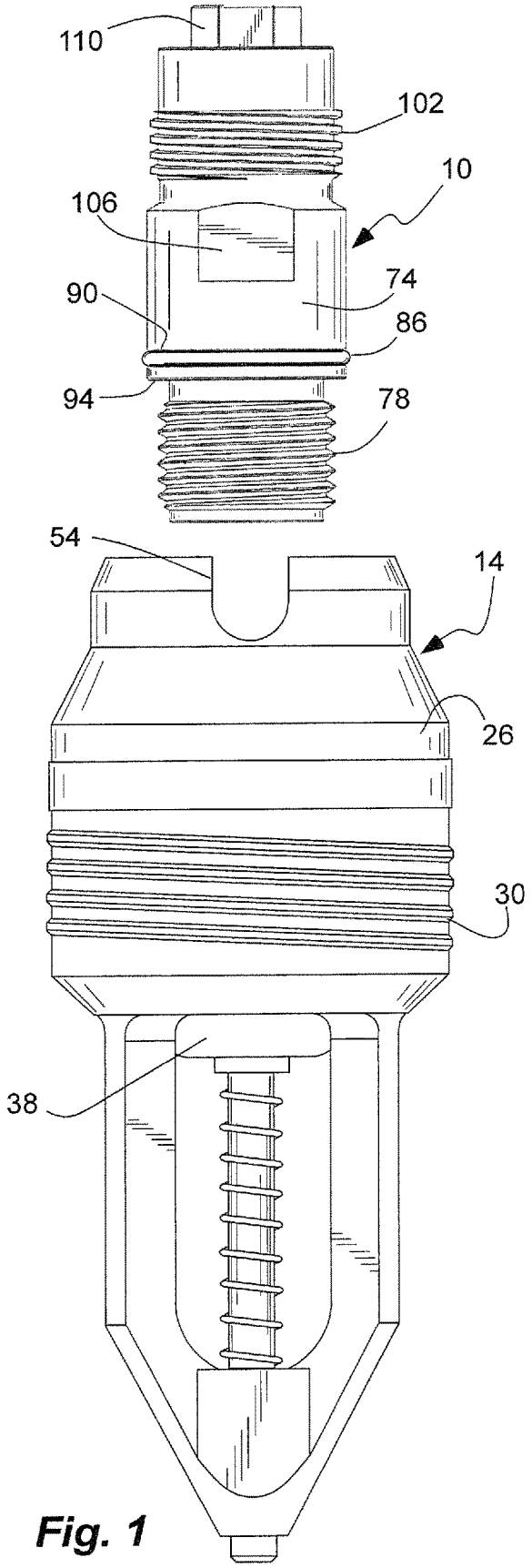
FIG. 1 is a schematic exploded side view of a valve and plug tool in accordance with an embodiment of the invention, showing a plug tool removed from a back pressure valve (BPV).
Figure 2:
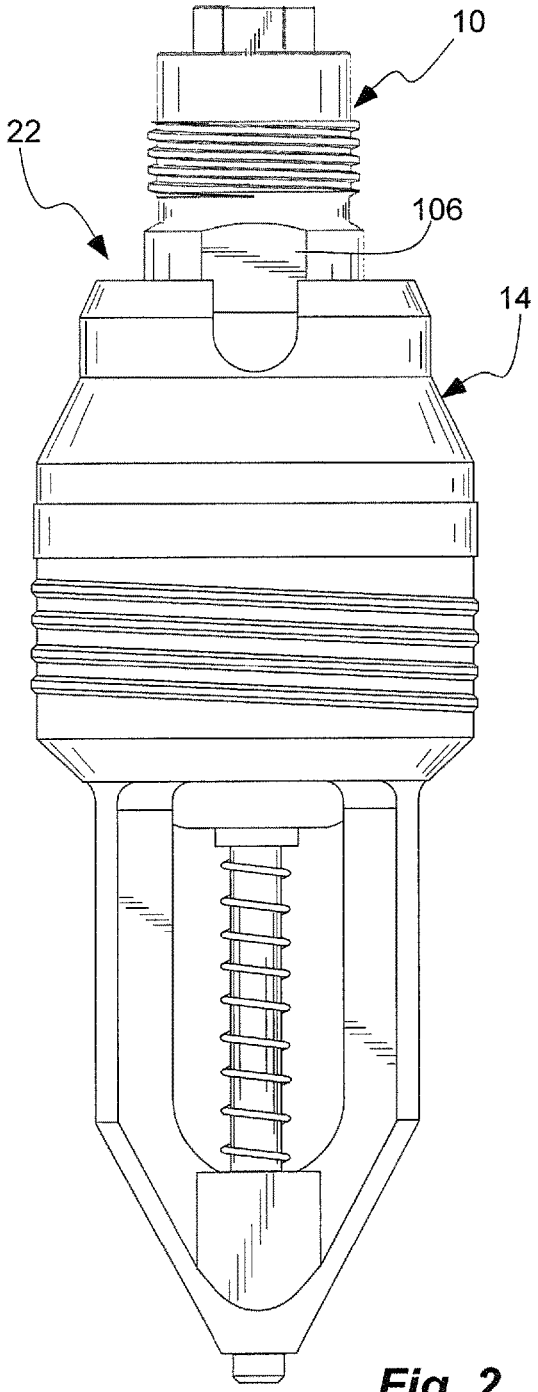
FIG. 2 is a schematic side view of the valve and plug tool of FIG. 1, showing the plug tool installed in the BPV.
Figure 3:
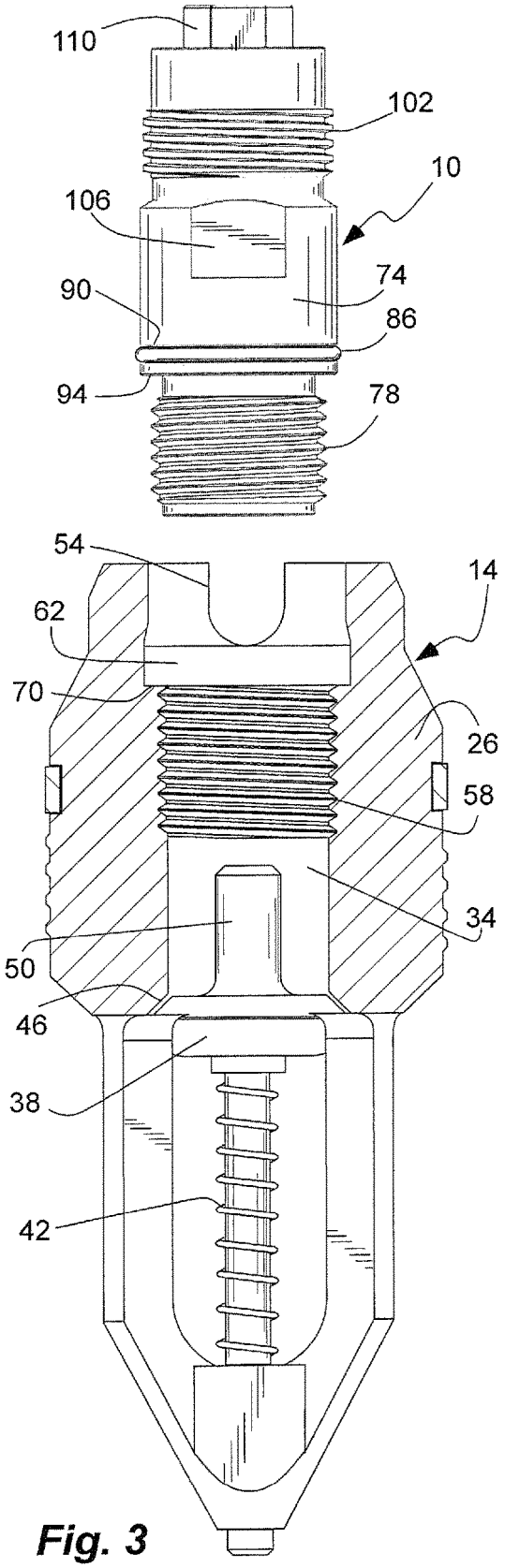
FIG. 3 is a schematic exploded partial cross-sectional side view of the valve and plug tool of FIG. 1, showing the plug tool removed from the BPV, and showing the BPV in partial cross-section.

Reference will now be made to the exemplary embodiments illustrated, and specific language will be used herein to describe the same. It will nevertheless be understood that no limitation of the scope of the invention is thereby intended.

DETAILED DESCRIPTION

Although the following detailed description contains many specifics for the purpose of illustration, a person of ordinary skill in the art will appreciate that many variations and alterations to the following details can be made and are considered to be included herein.

Accordingly, the following embodiments are set forth without any loss of generality to, and without imposing limitations upon, any claims set forth. It is also to be understood that the terminology used herein is for the purpose of describing particular embodiments only, and is not intended to be limiting.

Unless defined otherwise, all technical and scientific terms used herein have the same meaning as commonly understood by one of ordinary skill in the art to which this disclosure belongs.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

"The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

As used herein, "enhanced," "improved," "performance-enhanced," "upgraded," and the like, when used in connection with the description of a device or process, refers to a characteristic of the device or process that provides measurably better form or function as compared to previously known devices or processes. This applies both to the form and function of individual components in a device or process, as well as to such devices or processes as a whole.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the relative placement of one object with respect to another object. In some examples, objects that are described as being "adjacent" to one another may be in a side-by-side or other similar positional relationship that can include objects that are in direct contact with one another and objects that are in close proximity to one another. The exact degree of proximity may in some cases depend on the specific context.

As used herein, "coupled" refers to a relationship of connection or attachment between one item and another item, and includes relationships of either direct or indirect connection or attachment. Any number of items can be coupled, such as materials, components, structures, layers, devices, objects, etc.

As used herein, "directly coupled" refers to a relationship of physical connection or attachment between one item and another item, where the items have at least one point of direct physical contact.

As used herein, "indirectly coupled" refers to a relationship of connection or attachment between one item and another item where the items do not have a point of direct physical contact with one another. Rather, such items can be connected, attached, or joined together by an intermediate item. For example, when a first layer of material is bound or joined to a second layer of material using an intermediate layer in between the first and second layer, the first and second layers can be said to be indirectly coupled.

Unless otherwise specified, the terms "plug tool" and "plug" are used interchangeably herein.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

A plug tool is presented to selectively plug a back pressure valve (BPV) in a tubing hanger associated with a wellhead of a well. In one aspect, the plug can be used with an existing BPV modified to better accommodate the plug tool, and provide a matching seal. In another aspect, the plug tool and the BPV can be provided together as a valve and plug tool. The plug tool, and the valve and plug tool, can seal bottom hole pressure from the well during removal of the Christmas tree, and can retain control of the well while the Christmas tree is removed. Thus, the plug tool, and the valve and plug tool, allow a blowout preventer (BOP) to nipple-up and be tested without removing the BPV and without replacing the BPV with a two-way check valve. Thus, the plug tool, and the valve and plug tool, allows the BOP to be tested from above. In addition, the plug tool can selectively plug the BPV without contacting a poppet in the BPV, and thus without modifying well control. In addition, the plug tool can be removed while the BPV is still installed. Thus, if there is well pressure from below, the BPV allows pumping of kill fluid through the BPV to normalize pressure, such as vacuum.

A wellhead consists of the pieces of equipment mounted at the opening of the well to regulate and monitor the extraction of hydrocarbons from the underground formation. The equipment also prevents leaking of oil or natural gas out of the well, and prevents blowouts due to high pressure formations. Formations that are under high pressure typically require wellheads that can withstand a great deal of upward pressure from the escaping gases and liquids. The wellhead can comprise three components, namely: the casing head, the tubing head, and the Christmas tree.

The Christmas tree provides well control and can be used in an emergency shut down system. The Christmas tree is positioned on the top of the wellhead casing system and provides an interface between the well and the production and process facility. The Christmas tree has an assembly of gate valves which control the flow of hydrocarbons. The Christmas tree can have individual valves bolted together, or it can have a cast or forged steel solid block in which valve chests are machined, or a combination of both. The valve seats and gates can be removable for replacements or repair. A typical Christmas tree can have a master gate valve, a pressure gauge, a wing valve, a swab valve, a choke, and a number of check valves.

The casing head is mounted to a casing hanger. Several valves and plugs will normally be fitted to give access to the casing to allow the casing to be opened, closed, and bled down, and sometimes to allow the flowing well to be produced through the casing as well as the tubing. The tubing hanger is used to position tubing in the well.

Referring to FIGS. 1-5, one example of a plug tool 10 is shown to selectively plug a back pressure valve (BPV) 14 for use in tubing hanger 18 (FIG. 5) associated with a wellhead of a well. In one aspect, the plug tool 10 can be provided for use with an existing BPV 14, and the existing BPV 14 can be modified for use with the plug tool 10. In another aspect, the plug tool 10 and BPV 14 can be provided together, and can together form a valve and plug tool 22.

Figure 5:
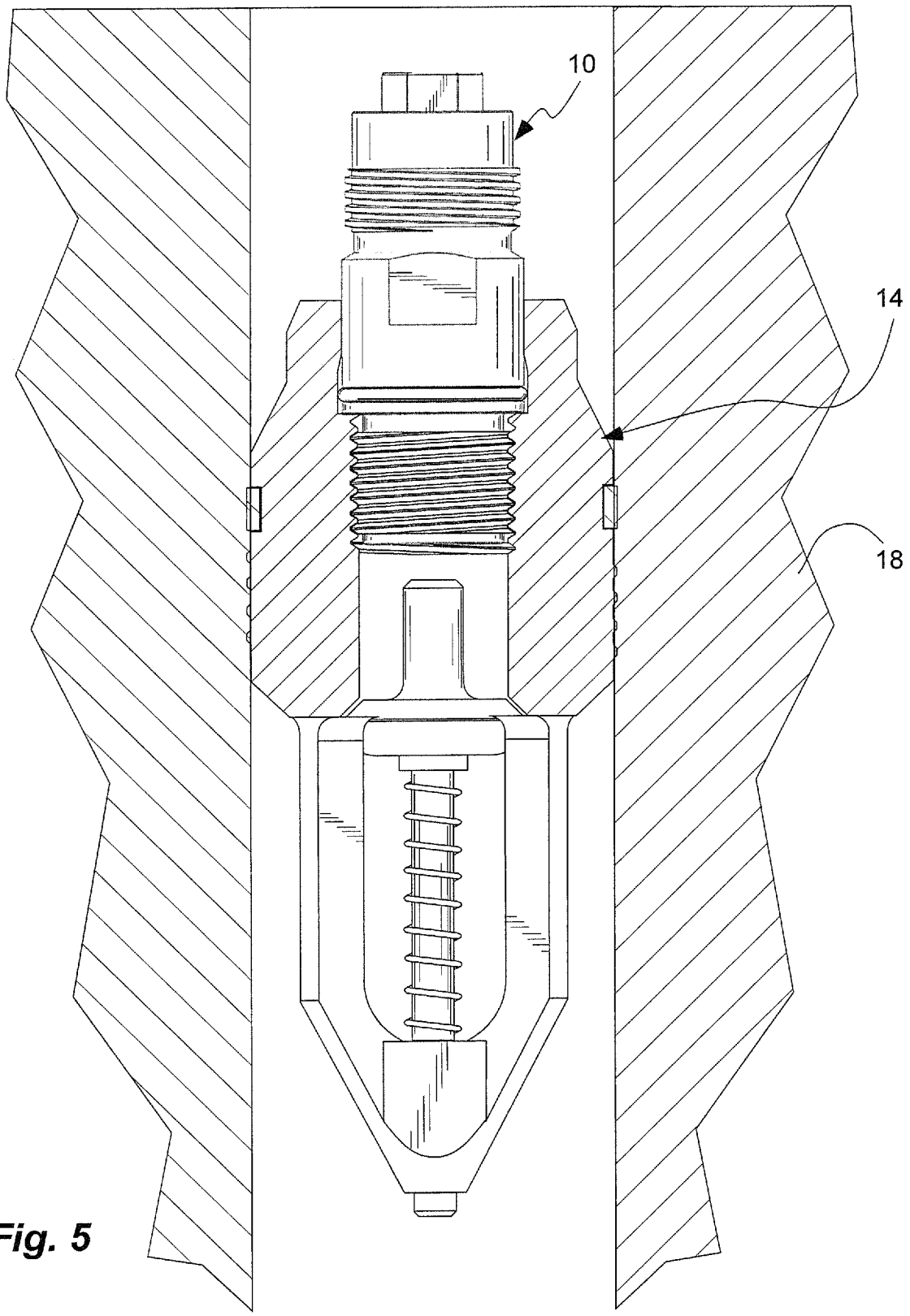
FIG. 5 is a schematic exploded partial cross-sectional side view of the valve and plug tool of FIG. 1, showing the BPV installed in a tubing hanger of a wellhead of a well, and showing the plug tool installed in the BPV, and showing the BPV in partial cross-section.

The BPV 14 is removably disposable in the tubing hanger 18, as shown in FIG. 5, and is capable of isolating the tubing and sealing bottom hole pressure from the well. The BPV can seal off the well from down hole pressure during removal of the Christmas tree from the wellhead, and while allowing fluid to be pumped into the tubing. Thus, the BPV is and defines a check-valve. The BPV has a valve body 26 with external screw threads 30 configured to threadably engage the tubing hanger 18. The external screw threads 30 can be left hand screw threads. A bore 34 extends through the valve body 26 and has an open upper end and an open bottom end. A poppet 38 is movable in the bore 34 and biased by a spring 42 against a seat 46 in the valve body 26. The seat 46 faces downwardly and outwardly with respect to the bore 34 and the valve body 26. Downhole pressure from the well pushes up against the poppet 38 and forces the poppet 38 into contact with the seat 46. Thus, the BPV seals bottom hole pressure from the well. The poppet 38 is displaceable downwardly by fluid pumped into the well against the biasing force of the spring 42. Thus, the BPV allows fluid, such as kill fluid, to be pumped into the well. The poppet 38 also has a stem 50 extending upwardly into the bore 34. The poppet 38 can be engaged and pressed downwardly, displacing the poppet 38 and opening the BPV 14, by a tool, such as a pulling tool 140 described below.

The BPV 14 and the valve body 26 also have a slot 54 in a top of the valve body 26 extending across the valve body 25 and the bore 34. The slot 54 can receive a cross pin of a tool, such as a running tool, for setting and removing the BPV 14 with respect to the tubing hanger 18. The BPV 14 and the valve body 26 also have internal screw threads 58 in the bore 34 and located between the poppet 38, and the stem 50 thereof, and the slot 54. Thus, the internal screw threads 58 are located above the poppet 38, and below the slot 54. The internal screw threads 58 can be right had screw threads. An annular, circumferential inner wall 62 is formed in the bore 34 that is parallel with a longitudinal axis 66. The inner wall 62 is positioned between the slot 54 and the internal screw threads 58. The inner wall 62 is flat with an axially flat surface without screw threads. Thus, the inner wall 62 can define a seal surface located above the internal screw threads 58 and below the slot 54, and also above the poppet 38. Thus, the seal surface can be utilized without interfering with the poppet 38, as described below. In addition, an annular step 70 is formed in the bore 34 perpendicularly to the longitudinal axis 66. The step 70 can be located between the inner wall 62 and the internal screw threads 58. The step 70 can define a stop for the plug tool 10 as described below.

For setting the BPV 14, a running tool is inserted into the right-hand thread 58 at the top of the BPV, and then attached to a rod. When the BPV has been lowered into the tubing hanger 18, the rod is lowered so that a cross pin in the running tool engages in the slot 54 on the top of the BPV. Left hand (anti-clockwise) rotation is applied to insert the BPV 14 into the tubing hanger 18. Once the BPV 14 is fully seated, the rod is moved up to lift the pin from the slot 54 and left-hand rotation backs out the running tool from the BPV. For removal of the BPV 14, a pulling tool is attached to the rod and lowered to the BPV. Right-hand (clockwise) rotation makes up the pulling tool. The rod is lowered into the slot 54 on the top of the PBV 14 and right-hand (clockwise) rotation removes the BPV from the tubing hanger 18.

The plug tool 10 can be removably coupled to the BPV 14 to selectively and completely plug the bore 34 of the BPV 14 and the valve body 26. The plug tool 10 has a plug body 74 with opposite upper and lower ends. In one aspect, the plug tool 10 and the plug body 74 can be formed of steel, and can be machined from rod stock. The plug tool 10 and the plug body 74 have lower screw threads 78 on the lower end of the plug body that match the internal screw threads 58 of the valve body 26 of the BPV 14. In one aspect, the lower screw threads 78 of the plug 10 are right-hand screw threads. Together, the lower screw threads 78 of the plug tool 10, and the inner screw threads 58 of the BPV 14, form a threaded connection 82 between the plug tool 10 and the BPV 14 that removably couples the plug tool 10 to the BPV 14, and the plug body 74 to the valve body 26.

Figure 4:
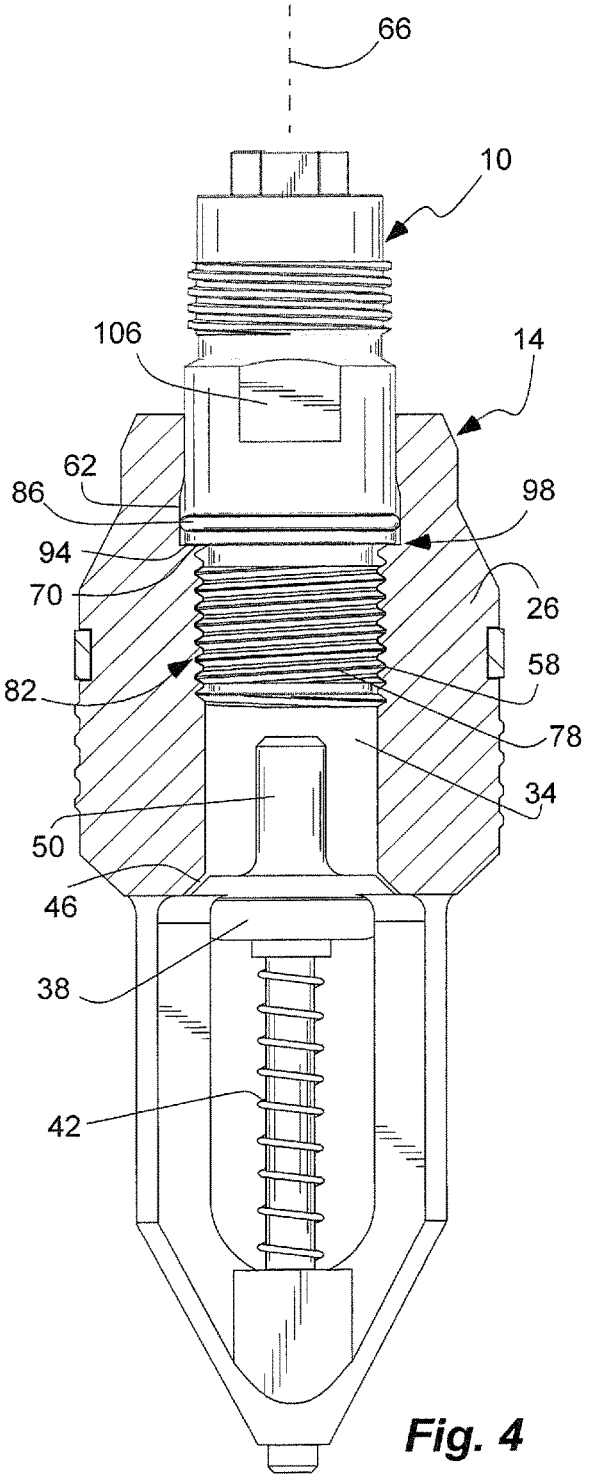
FIG. 4 is a schematic exploded partial cross-sectional side view of the valve and plug tool of FIG. 1, showing the plug tool installed in the BPV, and showing the BPV in partial cross-section.

The plug tool 10 also carries a seal 86 to seal between the plug body 74 and the seal surface 62 of the bore 34 of the BPV 14. Thus, the seal 86 is located above the threaded connection 82 when the plug tool 10 and the plug body 74 are coupled to the BPV 14 and the valve body 26, as shown in FIG. 4. The seal 86 is above the internal screw threads 58 of the BPV 14, above the poppet 38 and the seat 46, and below the slot 54. Thus, the plug tool 10 does not engage, contact, or interfere with the poppet 38 of the BPV 14 during use. In one aspect, an annular grove 90 can circumscribe the plug body 74 above the lower screw threads 78, and the seal 86 can be carried in the annular grove 90 to seal between the annular groove 90 and the seal surface 62.

In addition, the plug tool 10 has an annular flange 94 or shoulder circumscribing the plug body 74 and located above the lower screw threads 78 and below the seal 86. The annular flange 94 abuts to the annular step 70 in the bore 34 of the valve body 26 when the plug tool 10 and the plug body 74 are coupled to the BPV 14 and the valve body 26, as shown in FIG. 4. The annular step 70 and the annular flange 94 are positioned with respect to the valve body 26 and the plug body 74, respectively, to define a full stop 98 of the plug tool 10 with respect to the BPV 14 that is short of engaging the poppet 38 or the stem 50 thereof. Thus, a gap or space is defined between a bottom of the plug tool 10 (and the plug body 74) and a top of the poppet 38 (or the stem 50 thereof) when the plug tool 10 is fully seated and fully installed in the BPV 14, and when the annular flange 94 abuts the annular step 70 so that the plug tool 10 does not interfere with the poppet 38 of the BPV 14.

In addition, the plug tool 10 has upper screw threads 102 near the upper end of the plug body 74. The upper screw threads 102 can be different than the lower screw threads 78 of the plug tool 10, and different than the internal screw threads 58 of the BPV 14. Thus, the different screw threads 78 and 102 resist inadvertent installation of the plug tool 10 upside down. The upper screw threads 102 can also define retrieving threads to match internal screw threads of a retrieval tool 120, as discussed below. In one aspect, the upper screw threads 102 of the plug 10 can be left-hand screw threads, while the lower screw threads 78 are right hand screw threads. In another aspect, the upper and lower screw threads 102 and 78 of the plug tool 10 can have different profile shapes, as shown. For example, the lower screw threads 78 can have a saw tooth or triangular profile, while the upper screw threads 102 can have a more square profile. In another aspect, the upper and lower screw threads 102 and 78 of the plug tool 10 can have different diameters. For example, the upper screw threads 102 can have a greater diameter than the lower screw threads 78. Again, the different screw threads 78 and 102 resist mis-installment.

Furthermore, the plug tool 10 and the plug body 74 can have opposite flats 106 located intermediate the upper and lower screw threads 102 and 78. The flats 106 are also located to be exposed beyond the BPV 14 when the plug tool 10 is coupled to the BPV 14. The flats 106 can receive a tool, such as a wrench, to help tighten and loosen the plug tool 10 from the BPV 14, such as for testing, demonstration, or emergency purposes. The flats 106 can also be used in manufacture of the plug tool 10 and the plug body 74. The plug tool 10 and the plug body 74 can also have a bolt head 110 at a top of the plug body 74. The bolt head 110 can receive a tool, such as a wrench or socket, to help tighten and loosen the plug tool 10 from the BPV 14, such as for testing, demonstration, or emergency purposes.

Referring to FIG. 5, the plug tool 10 and the plug body 74 can be sized so that both the BPV 14 and the plug tool 10 are set below a neck of the tubing hanger 18. Thus, the positioning of the plug tool 10 is protected by the tubing hanger 18 from interference and damage by other tools.

Figure 6:
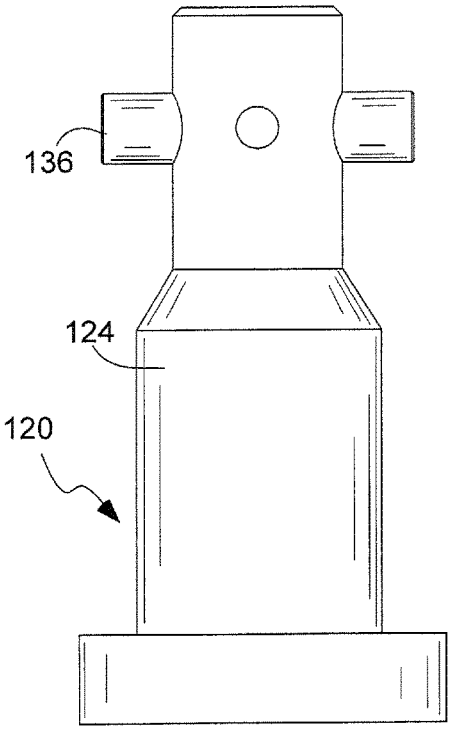
FIG. 6 is a side view of a retrieval tool in accordance with an embodiment of the invention for retrieving the plug tool from the BPV.
Figure 7:
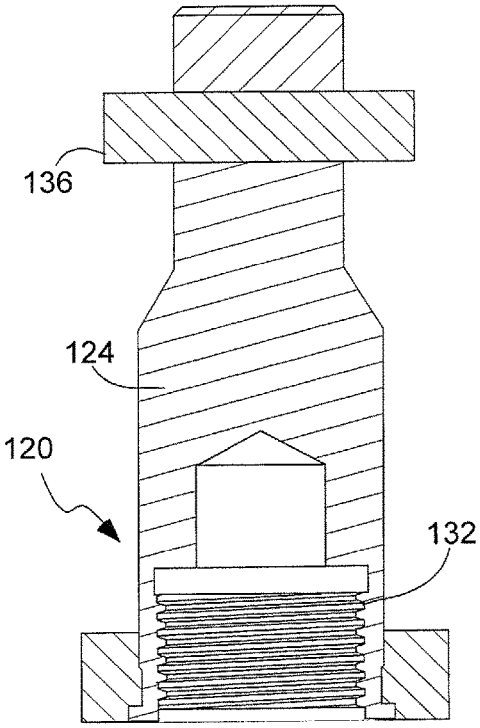
FIG. 7 is a cross-sectional side view of the retrieval tool of FIG. 6.
Figure 8:
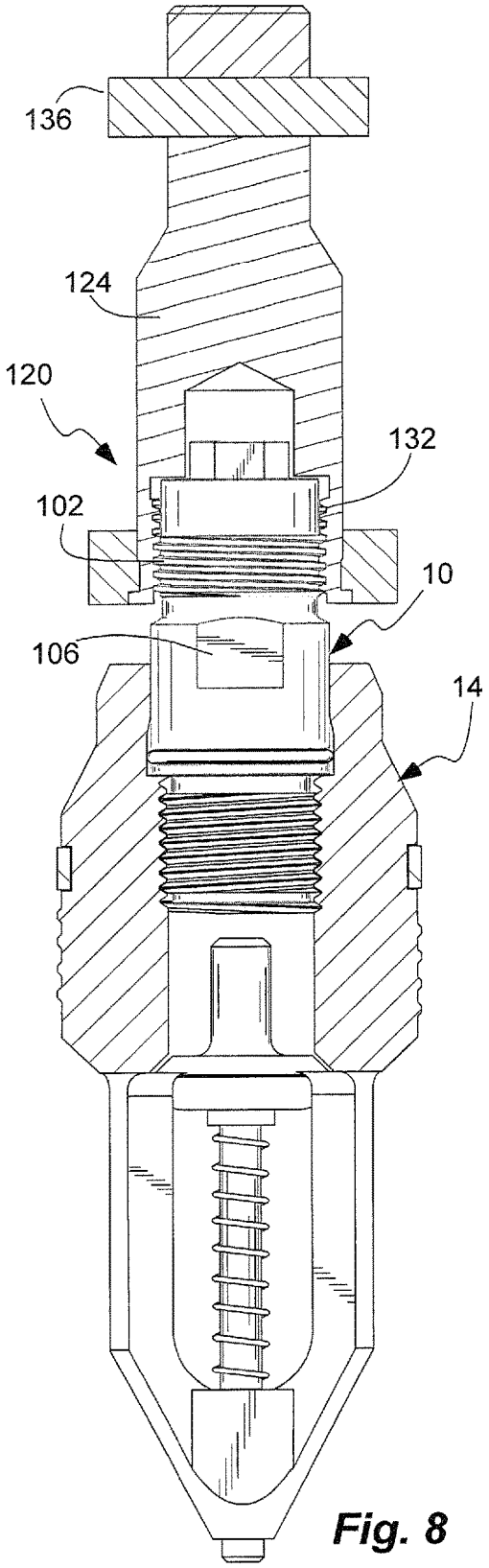
FIG. 8 is a schematic partial cross-sectional side view of the retrieval tool of FIG. 6 engaging the plug tool, showing the plug tool installed in the BPV, and showing the retrieval tool in cross-section and the BPV in partial cross-section.

Referring to FIGS. 6-8, as mentioned above, a retrieval tool 120 can be coupled to the plug tool 10 to set and remove the plug tool with respect to the BPV 14. The retrieval tool 120 can have a shank 124 with a bottom end and a top. A lower bore 128 can be formed in the bottom end of the shank 124. Internal screw threads 132 can be formed in the lower bore 128 of the shank 124 and can match the upper screw threads 102 of the plug tool 10. Thus, the internal screw threads 132 of the retrieval tool 120 can be left hand screw threads. A cross pin 136 can extending laterally from the top of the shank 124. In use, the retrieval tool 120 can engage the plug tool 10 with the internal screw threads 132 of the retrieval tool 120 engaging the upper screw threads 102 of the plug tool 10. In addition, the left hand screw threads 132 and 102 serve not only to connect the plug tool 10 to the retrieval tool 120, but to unthread the plug tool 10 from the PBV 14. As shown in FIG. 8, the flats 106 can also be exposed beyond the retrieval tool 120 to allow a tool to help remove the plug tool 10 from the retrieval tool 120.

Figure 9:
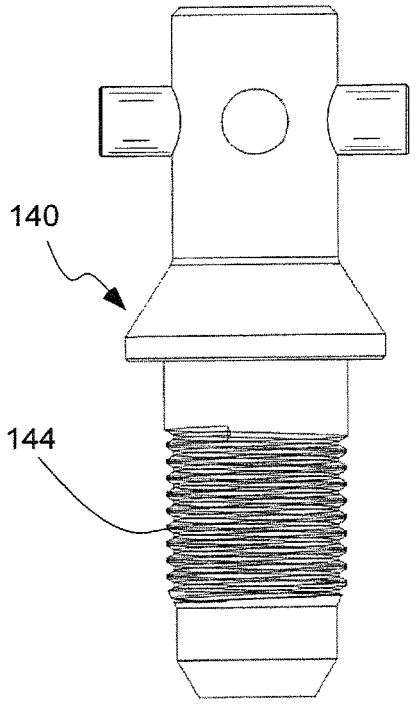
FIG. 9 is a side view of a pulling tool in accordance with an embodiment of the invention for pulling the BPV from the tubing hanger.
Figure 10:
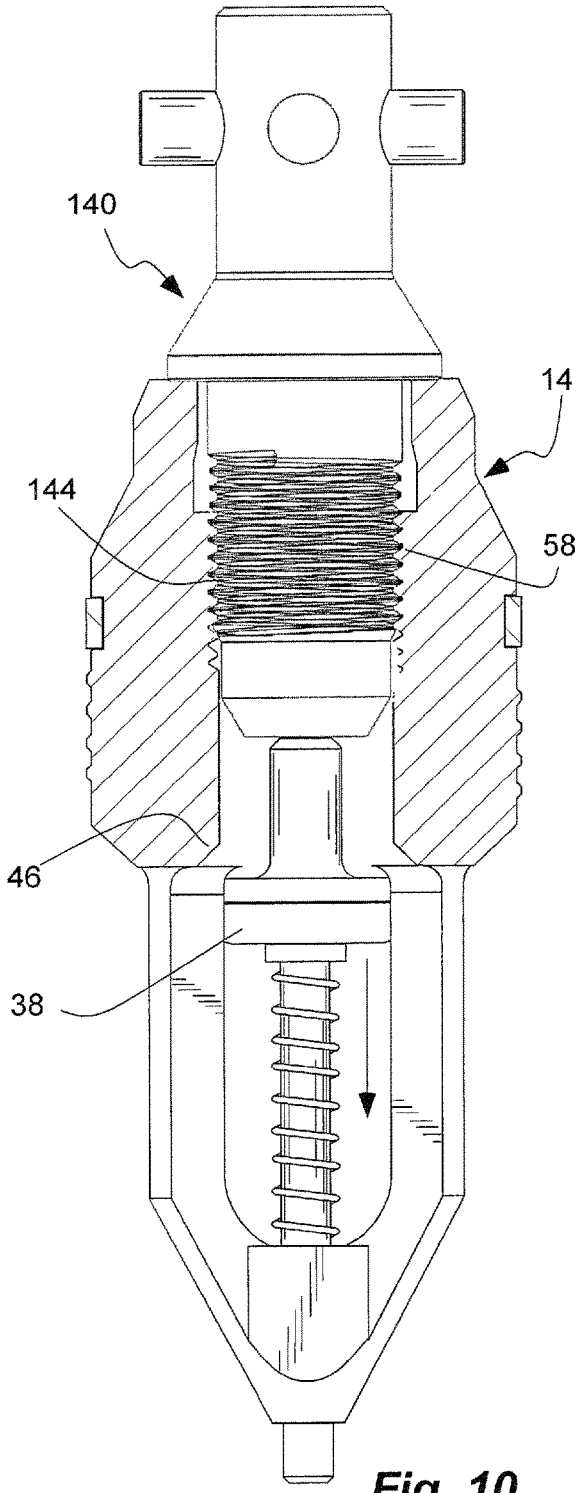
FIG. 10 is a schematic partial cross-sectional side view of the pulling tool of FIG. 9 engaging the BPV, showing the BPV in partial cross-section.

Referring to FIGS. 9 and 10, as mentioned above, a pulling tool 140 can be coupled to the BPV 14 to set and remove the BPV with respect to the tubing hanger 18. The pulling tool 140 can have lower screw threads 144 to match the internal screw threads 58 of the PBV 14. A bottom of the pulling tool 140 can extend beyond the lower screw threads 144 of the pulling tool 140 to engage the puppet 38 or the stem 50 thereof. Thus, the pulling tool 140 not only engages the BPV for removal, but displaces the poppet 38 to relieve any pressure.

A method for servicing a wellhead with a tubing hanger 18, a Christmas tree and a blow out preventer (BOP) with the valve and plug tool 22 described above comprises:

- setting the BPV 14 through the Christmas tree and into the tubing hanger 18, such as with the pulling tool 140 or the like;
- nippling down the Christmas tree;
- inserting and threading the plug tool 10 into the BPV 14 to seal the BPV without touching the poppet 38 or changing well control, such as with the retrieval tool 120;
- testing the BOP from above; and
- removing the plug tool 10, such as with the retrieval tool 120.

In addition, the method can further comprise pumping kill fluid through the BPV 14 to kill the well and establish a vacuum when there is pressure from below; and pulling the BPV 14 without using a two-way valve or a lubricator or a plug that screws into a lift thread of the tubing hanger 18.

Some aspects of a BPV are shown in U.S. Pat. No. 4,825,945, which is hereby incorporated herein by reference.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A valve and plug tool configured for use in a tubing hanger associated with a wellhead of a well, the tool comprising:

- a back-pressure valve (BPV) removably disposable in the tubing hanger and configured to isolate tubing and seal bottom hole pressure from the well while allowing fluid to be pumped into the tubing, defining a check-valve, and comprising:
  - a valve body with external screw threads configured to threadably engage the tubing hanger;
  - a bore extending through the valve body;
  - a poppet movable in the bore and biased against a seat in the valve body;
  - a slot in a top of the valve body configured to receive a tool for setting and removing the BPV with respect to the tubing hanger;
  - internal screw threads in the bore between the poppet and the slot;
  - an annular, circumferential inner wall in the bore and positioned between the slot and the internal screw threads with an axially flat surface without screw threads, defining a seal surface; and
  - an annular step in the bore defining a stop; and
- a plug removably couplable to the BPV and configured to selectively and completely plug the bore of the BPV, and configured to completely plug the BPV, and comprising:
  - a plug body with opposite upper and lower ends;
  - lower screw threads on the lower end of the plug body and matching the internal screw threads of the valve body of the BPV to form a threaded connection between the plug and the BPV and removably couple the plug to the BPV;
  - an annular grove circumscribing the plug body above the lower screw threads;

a seal carried in the annular grove and located above the lower screw threads, and configured to seal between the annular groove of the plug body and the seal surface of the bore of the BPV above the threaded connection when the plug body is coupled to the BPV;

an annular flange circumscribing the plug body and configured to abut to the annular step in the bore of the valve body, the annular step and the annular flange positioned with respect to the valve body and the plug body, respectively, to define a full stop of the plug with respect to the BPV short of engaging the poppet; and upper screw threads near the upper end of the plug body, the upper screw threads being different than the lower screw threads of the plug and the internal screw threads of the BPV, the upper screw threads defining retrieving threads configured to match internal screw threads of a retrieval tool.

2. The tool of claim 1, further comprising:

a space between a bottom of the plug body and the poppet of the BPV when the plug is fully installed in the BPV so that the plug does not interfere with the poppet of the BPV.

3. The tool of claim 1, further comprising:

a retrieval tool couplable to the plug and configured to set and remove the plug with respect to the BPV, and comprising:

a shank with a bottom end and a top;

a lower bore in the bottom end of the shank;

internal screw threads in the lower bore of the shank and matching the upper screw threads of the plug; and a cross pin extending laterally from the top of the shank.

4. The tool of claim 1, further in combination with a tubing hanger of a well head; and wherein both the BPV and the plug are set below a neck of the tubing hanger.

5. A method for servicing a wellhead with a tubing hanger, a Christmas tree and a blow out preventer (BOP) with the valve and plug tool in accordance with claim 1, the method comprising:

setting the BPV through the Christmas tree;

nippling down the Christmas tree;

inserting and threading the plug into the BPV to seal the BPV without touching the poppet or changing well control;

testing the BOP from above; and removing the plug.

6. The method of claim 5, further comprising:

pumping kill fluid through the BPV to kill the well and establish a vacuum when there is pressure from below; and pulling the BPV without using a two-way valve or a lubricator or a plug that screws into a lift thread of the tubing hanger.

7. A plug tool configured to selectively and completely plug a back-pressure valve (BPV) in a tubing hanger associated with a wellhead of a well, the plug tool comprising:

a plug body with opposite upper and lower ends;

lower screw threads on the lower end of the plug body configured to match internal screw threads of the BPV to form a threaded connection between the plug tool and the BPV and removably couple the plug body to the BPV;

a seal carried by the plug body and located above the lower screw threads, and configured to seal between the plug body and the BPV above the threaded connection when the plug body is coupled to the BPV;

upper screw threads near the upper end of the plug body, the upper screw threads being different than the lower screw threads of the plug and the internal screw threads of the BPV, the upper screw threads defining retrieving threads configured to match internal screw threads of a retrieval tool; and the upper and lower screw threads of the plug having different diameters; and the upper screw threads having a greater diameter than the lower screw threads.

8. The tool of claim 7, further comprising:

opposite flats intermediate the upper and lower screw threads of the plug body, and configured to be exposed beyond the BPV when the plug is coupled to the BPV.

9. The tool of claim 7, wherein the lower screw threads of the plug are right-hand screw threads; and wherein the upper screw threads of the plug are left-hand screw threads.

10. The tool of claim 7, wherein the upper and lower screw threads of the plug have different profile shapes.

11. The tool of claim 7, further comprising:

a bolt head at a top of the plug body of the plug.

12. The tool of claim 7, further comprising the BPV configured to be removably disposable in the tubing hanger and configured to isolate tubing and seal bottom hole pressure from the well while allowing fluid to be pumped into the tubing, defining a check-valve, and the BPV comprising:

a valve body with external screw threads configured to threadably engage the tubing hanger;

a bore extending through the valve body;

a poppet movable in the bore and biased against a seat in the valve body;

internal screw threads in the bore above the poppet; and an annular, circumferential inner wall the bore and positioned above the internal screw threads with an axially flat surface without screw threads, defining a seal surface to receive the seal of the plug tool when the plug tool is coupled to the BPV.

13. The tool of claim 12, further comprising:

an annular step in the bore of the BPV defining a stop; and an annular flange circumscribing the plug body and configured to abut to the annular step in the bore of the valve body, the annular step and the annular flange positioned with respect to the valve body and the plug body, respectively, to define a full stop of the plug with respect to the BPV short of engaging the poppet.

14. The tool of claim 12, wherein the internal threads in the valve body of the BPV are circumferentially continuous and without axial interruption.

15. The tool of claim 12, further comprising:

a space between a bottom of the plug body and the poppet of the BPV when the plug is fully installed in the BPV so that the plug does not interfere with the poppet of the BPV.

16. The tool of claim 12, further comprising:

a slot in a top of the valve body configured to receive a tool for setting and removing the BPV with respect to the tubing hanger.

17. A valve and plug tool configured for use in a tubing hanger associated with a wellhead of a well, the tool comprising:

a back-pressure valve (BPV) removably disposable in the tubing hanger and configured to isolate tubing and seal bottom hole pressure from the well while allowing fluid to be pumped into the tubing, defining a check-valve, and comprising:

a valve body with external screw threads configured to threadably engage the tubing hanger;

a bore extending through the valve body;

a poppet movable in the bore and biased against a seat in the valve body;

internal screw threads in the bore above the poppet;

an annular, circumferential inner wall in the bore with an axially flat surface without screw threads, defining a seal surface; and an annular step in the bore defining a stop; and a plug removably couplable to the BPV and configured to selectively and completely plug the bore of the BPV, and configured to completely plug the BPV, and comprising:

a plug body with opposite upper and lower ends;

lower screw threads on the lower end of the plug body and matching the internal screw threads of the valve body of the BPV to form a threaded connection between the plug and the BPV and removably couple the plug to the BPV;

a seal carried by the plug body and configured to sea between the plug body and the seal surface of the bore of the BPV when the plug body is coupled to the BPV; and an annular flange circumscribing the plug body and configured to abut to the annular step in the bore of the valve body, the annular step and the annular flange positioned with respect to the valve body and the plug body, respectively, to define a full stop of the plug with respect to the BPV short of engaging the poppet.

18. The tool of claim 17, further comprising:

the annular, circumferential inner wall and the seal surface being positioned above the internal threads in the bore of the valve body of the BPV;

the seal carried by the plug body being located above the lower screw threads; and the seal and the seal surface being configured to seal above the threaded connection.

19. The tool of claim 17, further comprising:

upper screw threads near the upper end of the plug body, the upper screw threads being different than the lower screw threads of the plug and the internal screw threads of the BPV, the upper screw threads defining retrieving threads configured to match internal screw threads of a retrieval tool.

* * * * *